US011285082B2

(12) United States Patent
Franck

(10) Patent No.: US 11,285,082 B2
(45) Date of Patent: Mar. 29, 2022

(54) DEVICE AND METHOD FOR THE DOSING OF ACTIVE SUBSTANCES FOR THE PREPARATION OF MEDICAMENTS

(71) Applicant: Jan Franck, Weidenberg (DE)

(72) Inventor: Jan Franck, Weidenberg (DE)

( * ) Notice: Subject to any disclaimer, the term of this patent is extended or adjusted under 35 U.S.C. 154(b) by 0 days.

(21) Appl. No.: 16/091,697

(22) PCT Filed: Apr. 5, 2017

(86) PCT No.: PCT/IB2017/000390
§ 371 (c)(1),
(2) Date: Oct. 5, 2018

(87) PCT Pub. No.: WO2017/175057
PCT Pub. Date: Oct. 12, 2017

(65) Prior Publication Data

US 2019/0159970 A1 May 30, 2019

(30) Foreign Application Priority Data

Apr. 5, 2016 (DE) ..... 10 2016 003 872.1

(51) Int. Cl.
*A61J 3/00* (2006.01)
*B41F 17/36* (2006.01)

(52) U.S. Cl.
CPC ..... *A61J 3/005* (2013.01); *A61J 3/00* (2013.01); *B41F 17/36* (2013.01)

(58) Field of Classification Search
CPC ..... A61J 3/00; A61J 1/16; B41J 17/36; B41F 17/36
See application file for complete search history.

(56) References Cited

U.S. PATENT DOCUMENTS 4,322,449 A * 3/1982 Voss ..... A61J 3/00 264/109
6,399,395 B1 * 6/2002 Zengerle ..... B01J 19/0046 422/507
7,767,130 B2 * 8/2010 Elsner ..... B33Y 10/00 264/308
7,867,548 B2 * 1/2011 Otis ..... B05D 1/26 101/35

(Continued)

FOREIGN PATENT DOCUMENTS

WO WO 03/041690 5/2003
WO WO-03041690 A2 * 5/2003 ..... A61J 3/10

(Continued)

*Primary Examiner* — Cachet I Proctor
(74) *Attorney, Agent, or Firm* — Pandiscio & Pandiscio

(57) ABSTRACT

The invention is directed to a method and a device for the dosing of active substances for the preparation of medicaments. In the context of the dosing method, one or more active substances dissolved in a liquid are stored in a storage container, and, in order to permit dosing, a number of drops corresponding to the desired amount of active substance are forced actively through a nozzle onto a substrate or into a collecting vessel; the device used for this purpose comprises at least one storage container for storage of a liquid, and one or more active substances dissolved therein, and also a nozzle through which a number of drops corresponding to the desired amount of active substance are forced out onto a substrate or into a collecting vessel.

31 Claims, 2 Drawing Sheets

(56) References Cited

U.S. PATENT DOCUMENTS

| | | | | |
|---|---|---|---|---|
| 8,122,849 | B2 * | 2/2012 | Clarke | A61J 3/00 118/668 |
| 9,044,037 | B2 * | 6/2015 | Ream | A23G 3/0021 |
| 2003/0012819 | A1 * | 1/2003 | Ko | A61K 9/0043 424/493 |
| 2005/0242209 | A1 * | 11/2005 | Holm | B05B 7/0475 239/451 |
| 2006/0000470 | A1 * | 1/2006 | Clarke | A61J 3/007 128/200.23 |
| 2006/0041248 | A1 | 2/2006 | Patton et al. | |
| 2008/0274266 | A1 * | 11/2008 | Davis | B05D 1/36 427/2.24 |
| 2011/0021964 | A1 * | 1/2011 | Larsen | A61L 26/0066 602/47 |
| 2011/0177590 | A1 * | 7/2011 | Clyne | H01F 1/0045 435/325 |
| 2015/0258276 | A1 * | 9/2015 | Schreier | A61B 5/0205 600/483 |

FOREIGN PATENT DOCUMENTS

| | | | |
|---|---|---|---|
| WO | WO 2010/012470 | 2/2010 | |
| WO | WO-2010012470 A1 * | 2/2010 | A61J 3/00 |

* cited by examiner

DEVICE AND METHOD FOR THE DOSING OF ACTIVE SUBSTANCES FOR THE PREPARATION OF MEDICAMENTS

REFERENCE TO PENDING PRIOR PATENT APPLICATIONS

This patent application claims benefit of International (PCT) Patent Application No. PCT/162017/000390, filed 5 Apr. 2017 by Jan Franck for DEVICE AND METHOD FOR THE DOSING OF ACTIVE SUBSTANCES FOR THE PREPARATION OF MEDICAMENTS, which claims benefit of German Patent Application No. DE 10 2016 003 872.1, filed 5 Apr. 2016, which patent applications are hereby incorporated herein by reference.

FIELD OF THE INVENTION

The invention is directed to a method and a device for the dosing of active substances for the preparation of medicaments. Since the method according to the invention is primarily concerned with the most precise possible dosing of the medicaments and less with the subsequent completion of the medicament in question, such as the thorough stirring of a cream, the filling of capsules or the transferring or packaging of the medicaments, etc., the terms "dosing method," "dosing device" or "dosing nozzle" are frequently often used below. No particular design features are intended with these terms, however; for example, any type of nozzle could basically be employed as a dosing nozzle according to the invention. Moreover, the term "medicament" should include not only medicines for treating illnesses but also preventive medications, such as vaccines, or cosmetic articles, such as beauty pills, or health-related preparations, such as nutritional supplements or tablets with particular vitamins or minerals like magnesium, zinc, iron, etc.

BACKGROUND OF THE INVENTION

Modern medicine is constantly making progress in numerous areas, and there specific medicaments for every illness, complaint or symptom. As a result, some people constantly have to take a larger number of different tablets, up to ten tablets or more a day, for instance. Often the individual tablets are difficult to distinguish from one another, and so it cannot be rules out that dosages are taken or given incorrectly.

It would therefore be desirable to find a way for particular people to gather their individual medicaments in such a way that, by mixing multiple active substances into one medicament, ideally only one single tablet would have to be taken every day, or at least only a single tablet per meal.

SUMMARY OF THE INVENTION

The described disadvantages associated with the described prior art result in the problem that initiated the invention, namely that of producing a dosing method and a dosing device for the preparation of medicaments which can be controlled individually so that a medicament can be prepared individually with a higher degree of precision.

Within the framework of a generic dosing method, the solution to this problem arises in that one or more active substances dissolved in a liquid are stored in a storage container and, for the dosage, a number of drops corresponding to the desired quantity of the active substance is actively pressed through a nozzle onto a substrate or into a collecting vessel.

The device employed to carry out the method comprises at least one storage container for storing a liquid together with one or more active substances dissolved within it as well as a nozzle for actively pressing a number of drops corresponding to the desired quantity of the active substance onto a substance or into a collecting vessel.

In this way, pharmacies or patient-side pharmaceutical companies, for example, would be enabled to prepare a medication that is precisely adapted to a patient based on a medically prescribed overall medication, such as in the form of a fluid but also possibly enclosed gelatin capsules, etc. The patient would thus be relieved of the responsibility of always choosing from a large number of medication packages and taking the types required for each meal in accordance with the medication plan.

This is achieved in that a device according to the invention has a number of storage containers at least corresponding to the required quantity of active substance, in which one active substance or a typical composition of active substances is contained in dissolved, liquid form, and the desired types and amounts of the active substance are introduced into a control device; the desired active substances are then sprayed in appropriate dosages through nozzles into a collecting vessel or onto a different, e.g. absorbent, substrate and are thereby prepared.

Preferably, a separate nozzle is provided for each active substance or typical active substance composition for the precise spraying of the liquid contained in the connected storage container. In this way, the active substance liquids contained in the storage container do not mix, and any possible substance liquid that is not needed and that is thus collected is precisely conducted back into its original storage container. The various active substances thus do not mix, and it is therefore still possible to distinguish exactly among the various active substance liquids even after a longer production period.

This is particularly advantageous because, based on a design recommendation according to the invention, spraying mechanisms are used in which nozzle heads that operate according to the continuous inkjet method and/or the inkjet printing method can be employed, wherein droplets are continuously produced, but droplets that are not required maybe be diverted, collected and returned.

Since spraying mechanisms of this type are wide-spread in the printing industry, it is further provided that prefabricated print heads for continuous inkjet printers and/or inkjet printers be used for this purpose whenever possible. They can then be utilized together with the storage containers as well as collection and return devices, with the difference that no inks are stored in the storage containers, but instead liquids with various dissolved active substances or typical combinations of active substances. A further difference is that the spray jet is generally not directed onto paper but rather into a collecting vessel, such as a prescription bottle to be given to the patient or an absorbent, edible substrate in fill form, which absorbs the sprayed-on active substance liquid.

BRIEF DESCRIPTION OF THE DRAWINGS

Further features, details, advantages and effects of the invention arise from the following description of a preferred embodiment of the invention and on the basis of the drawing.

The following is shown.

DETAILED DESCRIPTION OF THE PREFERRED EMBODIMENTS

With the system and principle according to the invention, medicaments can be produced in different forms, such as in the form of tables, particles for use in capsules, syrups, salves, aerosols or infusions and other solutions. In the process, a thin fluid active substance or a thin fluid active substance solution is generally dispensed in dose form onto a solid substrate or into a liquid solvent. Solid substrates in tablet form and liquids such as syrups, infusions or other solutions can then be immediately packaged and transported and/or administered. In the case of capsules, the medicament particles are still enclosed in the capsules; with creams or other viscous medicaments such as syrup, the substances should again be stirred before being packaged or administered.

Figure 1:
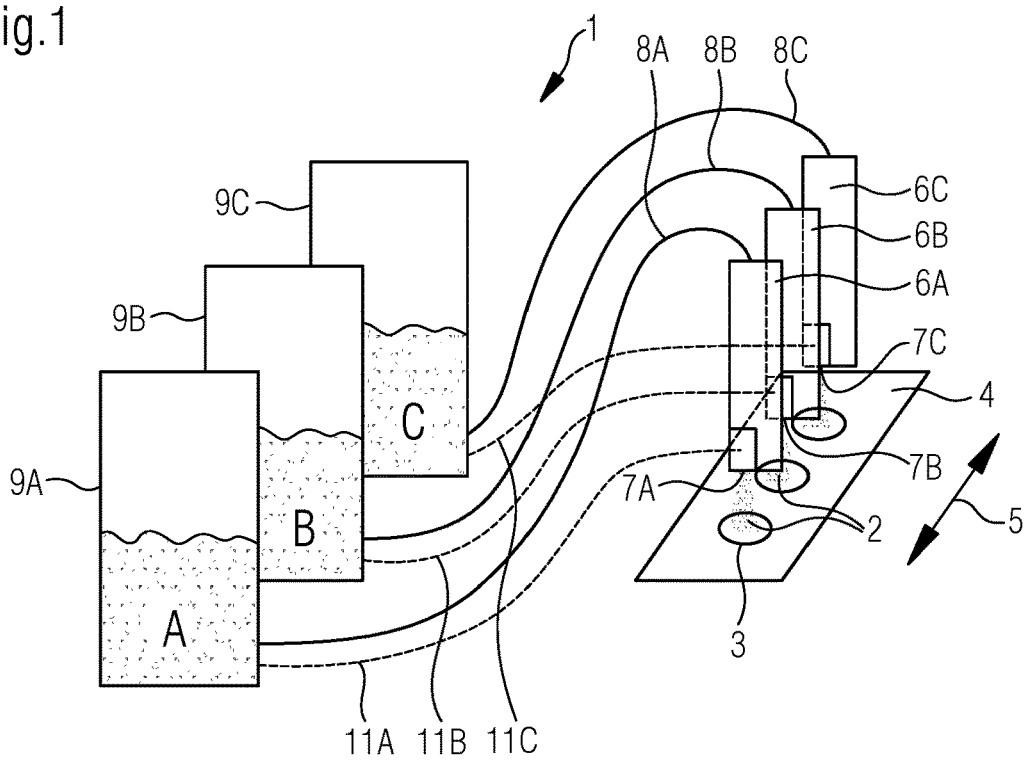
FIG. 1 perspective view of a device for the dosing of active substances for the preparation of medicaments, comprising a plurality of storage containers for various active substance solutions.

The active substance dosing device 1 shown in FIG. 1 is specifically designed for the production of medicaments in the form of tablets, but it could also be used in a nearly unmodified form for the production of medicaments in other dosage forms.

Multiple tablet-like substrate bodies 2 for receiving active substances can be seen on the right side of FIG. 1. The tablet-like substrate bodies 2 are "tablet blanks", for instance, i.e. tablet bodies consisting of a harmless substance that can be degraded in the digestive tract but that should be absorbent, i.e. porous, so that it can soak up and retain an active substance. This kind of tablet-like substrate body 2 could thus be pressed into a typical tablet form from a powder. The tablet body 2 could possibly already contain preservatives so that an incorporated active substance has a longer shelf life; however, it should still be free of active substances themselves so that they can be metered into the tablet-like substrate body 2 individually for each patient by means of the dosing device 1 according to the invention.

The tablet-like substrate bodies 2 are located in depressions 3, for example. These can be the depressions of a so-called blister tray 4, i.e. depressions 3 in a flat sheet or in a flat band, which ensures that the tablet-like substrate bodies 2 are always in exactly predetermined positions, namely within the depressions 3.

Alternatively, the depressions 3 could also be incorporated into a correspondingly pre-molded foil that can later be completed as a blister card. Within the framework of a preferred embodiment, a foil provided with corresponding depressions 3 for a subsequent blister card could also be placed over a blister tray 4 in such a way that each depression 3 of the foil engages in a depression 3 of the blister tray 4 so that a centering orientation of the foil with depressions 3 occurs as a result of the blister tray 4 and so that a corresponding orientation of the tablet-like substrate bodies 2 received therein also occurs.

Medicaments according to the invention can basically also be packaged in the form of blister packs blister cups.

Furthermore, a conveying device is preferably provided to transport a blister tray 4 and/or a foil that is provided with depressions 3, for example, in a conveying direction 5, wherein said conveying direction 5 preferably runs horizontally.

One or more dosing mechanisms (three in the example shown here) 6A, 6B, 6C are positioned above the tablet-like substrate bodies 2 (when collecting vessels above them are used). A plurality of dosing mechanisms 6A, 6B, 6C are preferably arranged one in front of the other in a row, wherein this row should then extend parallel to the conveying direction 5. In other words, the dosing mechanisms 6A, 6B, 6C (three in the example shown) are arranged in succession in the conveying direction 5.

The dosing mechanisms 6A, 6B, 6C are preferably not displaceable, that is, in particular not on slides or the like, but are instead preferably permanently installed, i.e. fixed in place. Of course, it may be possible, for example, to lift or even remove them for purposes of disinfection, maintenance, repair, and/or replacement.

If the dosing mechanisms 6A, 6B, 6C are fixed in place, then only the conveying direction 5 and it conveying speed determine the relative movement between the dosing mechanisms 6A, 6B, 6C on the one hand and the tablet-like substrate bodies 2 being transported past them on the other hand.

Each of the dosing mechanisms 6A, 6B, 6C has a dosing nozzle unit 7A, 7B, 7C, which is preferably arranged on its bottom side and the dispensing direction of which is oriented precisely to a tablet-like substrate body 2 that is situated below it or being transported below it.

Preferably, the offset of adjacent dosing nozzle units 7A, 7B, 7C in the conveying direction 5 is equal to the offset of two adjacent depressions 3 in the blister trays 4. As a result, each of the dosing nozzle units 7A, 7B, 7C is positioned exactly above one tablet-like substrate body 2 at particular points in time.

Each dosing mechanism 6A, 6B, 6C is supplied with a liquid A, B, C via one first hose 8A, 8B, 8C from one storage container 9A, 9B, 9C, wherein the liquids A, B, C can selectively be various liquid active substances and/or various active substances that have been dissolved in a liquid. Each hose 8A, 8B, 8C can have its own feed pump 10 provided within it, the feed pump not being shown in FIG. 1 but only in FIG. 2, which displays an exemplary dosing mechanism 6 for the plurality of dosing mechanisms 6A, 6B, 6C that are constructed identically to each other.

Furthermore, each dosing mechanism 6A, 6B, 6C is coupled with the respectively associated storage container 9A, 9B, 9C via its own second hose 11A, 11B, 11C. Liquid A, B, C that is not required can flow back into the storage containers 9A, 9B, 9C through these hoses 11A, 11B, 11C.

Figure 2:
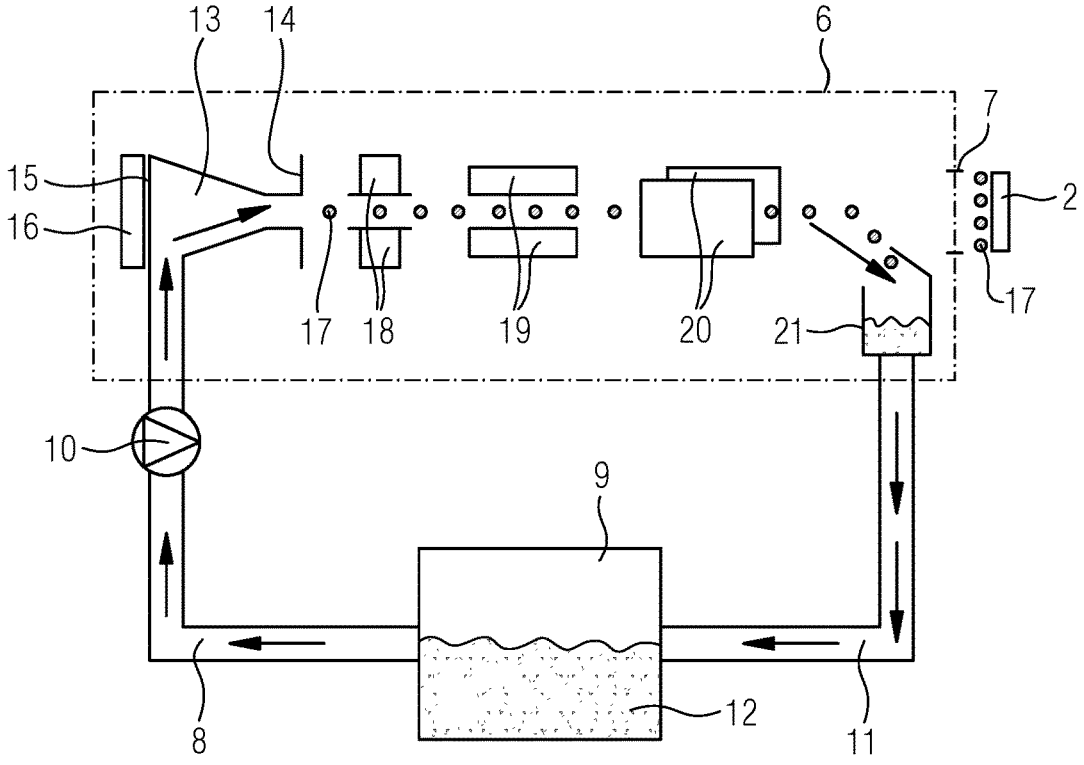
FIG. 2 a schematic view of a storage container for active substances according to FIG. 1 with the relevant circulation of the active substance.
Figure 3:
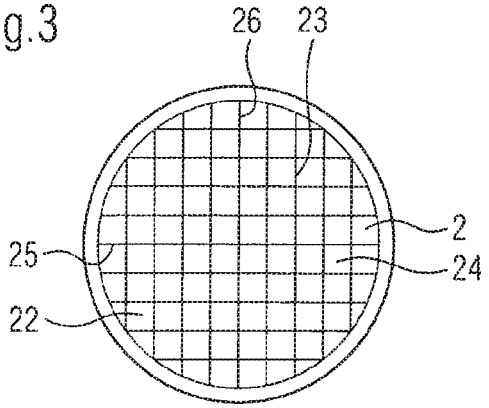
FIG. 3 a top view of a tablet-like substrate for receiving active substance solutions.

The schematic representation of a single dosing mechanism 6 in FIG. 2 serves to illustrate its operating principle.

However, the dosing mechanism 6 is shown in a horizontal position here—following the process flow—wherein the outer nozzle and/or nozzle unit 7 is on the right although, according to FIG. 1, it is typically used in the vertical position, wherein the outer nozzle and/or nozzle unit 7 is below.

It can be seen here that the pump 10 conveys the active substance liquid 12 from the respective storage container through the associated first hose 8 into a chamber 13 within the dosing mechanism 6 in question.

The chamber 13 includes the inner nozzle 14 as well as an at least partially moveable wall section 15 that can be displaced over an actuator, such as a piezo actuator 16, beyond the movable edge section 15. This (piezo) actuator 16 is linked to a control system that is not shown in the drawing and that specifies the respective displacement of the actuator and thus the position of the moveable edge section 15.

If the edge section 15 of the chamber 13 moves outwardly, i.e. away from the chamber 13, then active substance liquid 12 is suctioned out of the first hose line 8 into the chamber 13. If the edge section 15 then pivots into the chamber 13—under the control of the (piezo) actuator 16—then a droplet 17 of the active substance liquid 12 is moved at great speed through the inner nozzle 14 out of the chamber 13.

This droplet 17 initially flies through a pair of charging electrodes 18, where it is electrically charged.

It next encounters two pairs of deflection electrodes 19, 20, where it is first deflected in a first direction transverse to its direction of flight, and then in a second direction transverse to its direction of flight but perpendicular to the first deflection direction.

These pairs of deflection electrodes 19, 20 serve two purposes:

In the following, the first purpose of the deflection electrodes 19, 20 is explained: In order to utilize the resonance in the chamber 13, the piezo actuator 16 is normally activated with an uninterrupted alternating voltage at a frequency tuned to the resonant frequency of the chamber 13 so that droplets 17 are continuously produced at short intervals, including when there is currently no tablet-like substrate body 2 located at the desired position in the area and/or below the dosing nozzle unit 7. To keep these droplets 17 from being wasted, at least one pair of deflection electrodes 19, 20 is activated for these technically superfluous droplets 17 in such a way that the droplet 17 in question is strongly deflected, specifically in the direction of a collecting unit 21 in the associated dosing mechanism 6, from which the collected liquid 12 is then conducted back to the storage container 9 through the second hose line 11 and is thereby not lost.

On the other hand, if a tablet-like substrate body 2 that is to be impregnated is located at the desired position in the area and/or below the dosing nozzle unit 7, then the trajectory of a droplet 17 is controlled by the pairs of deflection electrodes 19, 20 in such a way that it strikes the tablet-like substrate body 2, provided that a sufficient number of droplets 17 of the active substance 12 in question have not already been dispensed onto that substrate body 2.

In the following, the second purpose of the deflection electrodes 19, 20 is explained: Moreover, the surface 22 of the tablet-like substrate body 2 facing the dosing nozzle unit 7 is virtually divided into a grid 23 with a multitude of fields 24, which are preferably sub-divided into rows 25 and columns 26, similar to a matrix or a chess board. In this context, "virtual" means that the grid 23 is not really present on the substrate body 2 or at least does not have to be present, but it is only saved in a control unit, which is capable of activating the deflection electrodes 19, 20 such that a droplet 17 strikes exactly a predetermined field 24 of the grid 23, in other words, such that it lands precisely in the desired row 25 and column 26 on the surface 22 of the substrate body 2. By way of example but not limitation, the two pairs of deflection electrodes 19, 20 may be rotated by 90° about the flight direction of the droplets 17 in order to deflect the electrically charged droplets 17 to different locations or fields 24 of a grid 23 of the substrate 2.

Preferably, all of the dosing mechanisms 6A, 6B, 6C are linked to a common control system. A superordinate control program can be stored there, which assigns an active substance liquid A, B, C to each field 24 of the grid 23.

This control system can then prompt the various dosing mechanisms 6A, 6B, 6C to place different droplets 17 in succession such that each field 24 is contacted by only one droplet 17 containing the assigned active substance liquid A, B, C and thus the substrate body is not locally flooded with a liquid 12.

Of course, different dosing mechanisms 6A, 6B, 6C do not dispense onto the same substrate body 2 at the same time, but instead only different substrate bodies 2 arranged in a row, either onto immediately successive substrate bodies 2 or possibly even onto substrate bodies 2 that are not even follow in immediate succession.

The interval of time that elapses as a substrate body is transported along the conveying direction 5 from a dosing unit 6A (or 6B) to the next dosing unit 6B (or 6C) at the speed of the conveying device gives the substrate body 2 sufficient time to absorb the active substance fluid A, B it has received before the next active substance fluid B, C is applied.

Figure 4A:
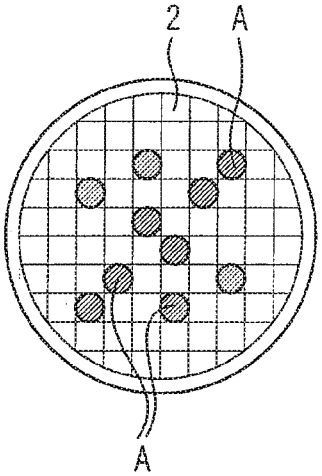
FIG. 4*a* the tablet-like substrate according to FIG. 3 after a first processing step of a first method for preparing a medicament, namely impregnation with active substance solution A.
Figure 4B:
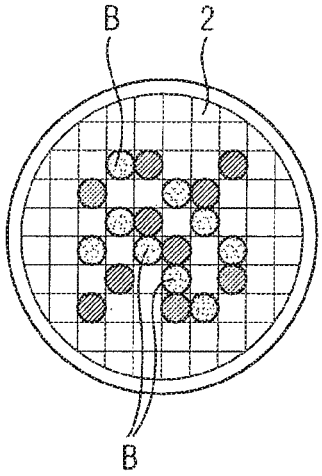
FIG. 4*b* the tablet-like substrate from FIG. 4*a* after a second processing step of the first method, namely impregnation with active substance solution B.
Figure 4C:
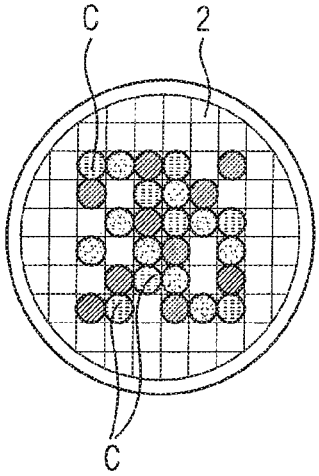
FIG. 4*c* the tablet-like substrate from FIG. 4*a* after a third processing step of the first method, namely impregnation with active substance solution C.

Various stages of this process can be seen in FIGS. 4*a*, 4*b* and 4*c*:

In FIG. 4*a*, only a first active substance fluid A was initially applied to the tablet-like substrate body 2 at the first dosing station and/or dosing mechanism 6A, specifically to the fields 24 in the upper right that are indicated by shading. Each of these shaded fields 24 can have received one or more droplets 17 of the active substance fluid A.

In the stage according to FIG. 4*b*, a second active substance fluid B has additionally already been applied to the tablet-like substrate body 2 at the second dosing station and/or dosing mechanism 6B, specifically to the fields 24 indicated by dotting that are adjacent to and/or between the shaded fields 24. Each of these dotted fields 24 can have received one or more droplets 17 of the active substance fluid B.

Finally, FIG. 4*c* shows the finished state, wherein a third active substance fluid C has also been applied to the tablet-like substrate body 2 at the third dosing station and/or dosing mechanism 6C, specifically to the dashed fields 24 adjacent to and/or between the shaded and dotted fields 24. Each of these dotted fields 24 can have received one or more droplets 17 of the active substance fluid C.

Once a film with multiple tablet-like substrate bodies 2, which are each accommodated in depressions 3 and impregnated by active substance fluids A, B, C, is transported far enough that it has arrived on the other side of all dosing mechanisms 6A, 6B, 6*c*, then it can be covered with a card and heat-sealed to it at a packaging station immediately downstream so as to produce a finished blister card.

Having arrived at one end of the transport mechanism, a sealed blister card such as this can then fall, for example, into a container, such as a shipping carton, in which it ultimately reaches the patient or other consumer.

Figure 5A:
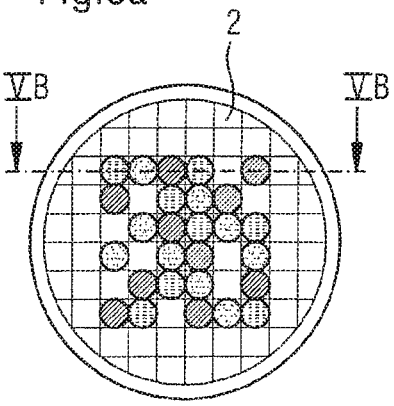
FIG. 5*a* a top view of the tablet-like substrate from FIG. 3 during a second method for preparing a medicament.
Figure 5B:
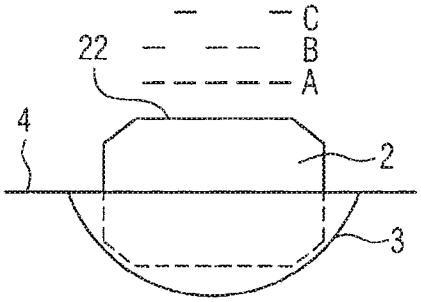
FIG. 5*b* a side view of the tablet-like substrate from FIG. 5*a*, wherein various method steps are indicated.

A different method according to the invention is portrayed in FIGS. 5*a* and 5*b*. This method differs from the one previously described primarily in that not all active substances A, B, C are applied exclusively in adjacent fields 24, but they can also be applied over each other, i.e. multiple different active substances A, B, C land in the same field 24.

This is possible because a certain amount of time elapses between the individual dosing processes at the various dosing stations 6A, 6B, 6C due to the necessary transport of the substrate bodies 2, during which time an active substance liquid A, B that was previously applied can penetrate into the substrate body 2 before the next active substance liquid B, C is applied.

In FIG. 5*b*, it is indicated above the tablet-like substrate body 2 that a first active substance liquid A is initially applied in particular fields 24, and a different active substance liquid B or C is later applied, as well.

Particular sequences in the release of the active substances in the stomach could be induced by this process by the fact that active substances that penetrated later and only superficially are released earlier than those that penetrated earlier and more deeply.

LIST OF REFERENCE SIGNS

1 Active agent dosing device
2 Tablet-like substrate
3 Depression
4 Blister tray
5 Conveying direction
6 Dosing mechanism
7 Dosing nozzle unit
8 First hose
9 Storage container
10 Feed pump
11 Second hose
12 Active agent liquid
13 Chamber
14 Inner nozzle
15 Moveable edge section
16 (Piezo) Actuator
17 Droplet
18 Charging electrodes
19 Deflection electrodes
20 Deflection electrodes
21 Collecting unit
22 Surface
23 Grid
24 Field
25 Row
26 Column

The invention claimed is:

1. An active substance dosing method for the preparation of tablet-like medicaments, characterized in that one or more active substances (A, B, C) are dissolved in one liquid (12) each and are stored in a storage container (9), and, to be dosed, a number of droplets (17) corresponding to the desired amount of active substance (A, B, C) is actively pressed, not under the influence of gravity alone, through at least one dosing nozzle (7, 14) onto tablet-like substrate bodies (2), which are located in depressions (3) incorporated in a flat sheet or in a flat band or in a pre-molded foil that can later be completed as a blister card, wherein multiple active substance droplets (17) are deflected by two pairs of deflection electrodes (19, 20), which are rotated by 90° about the flight direction of the droplets (17) in order to deflect the electrically charged droplets (17) to different locations or fields (24) of a grid (23) of the substrate (2) differently in two spatial directions so that they strike different fields (24) of a grid (23) on a substrate (2).

2. The method according to claim 1, characterized in that droplets (17) are continuously generated, but, depending upon the desired amount of active substance (A, B, C), only the droplets (17) that are required are pressed onto a substrate (2) or into a collecting vessel while the droplets (17) that are not required are collected and conducted back into the storage container (9).

3. The method according to claim 2, characterized in that the differentiation between required droplets (17) and the unneeded droplets (17) is made by differently deflecting the droplet stream.

4. The method according to claim 1, characterized in that, after passing through an inner dosing nozzle (14), the droplets (17) are electrically charged on a charging electrode (18).

5. The method according to claim 4, characterized in that the electrically charged droplets (17) are deflected differently between two deflection electrodes (19, 20) depending upon their classification such that required droplets (17) arrive on a substrate (2) or in a collecting vessel, while unneeded droplets (17) are sent to a collecting device (21), from which they are conducted back into the storage container (9).

6. The method according to claim 1, characterized in that a print head of a continuous inkjet printer is used as the dosing mechanism.

7. The method according to claim 1, characterized in that multiple droplets (17) with the same or different active substances (A, B, C) are deflected to the same locations or fields (24) of a grid (23) on a substrate (2).

8. The method according to claim 1, characterized in that the at least one dosing mechanism (6) and/or the at least one dosing nozzle (7, 14) and/or the at least one deflection mechanism are disinfected before the start of the medicament preparation and/or at regular intervals.

9. An active substance dosing device (1) for the preparation of medicaments, characterized by a plurality of storage containers (9A, 9B, 9C) each for storing one liquid (12) together with one or more active substances (A, B, C) that are dissolved within it, a plurality of dosing mechanisms (6A, 6B, 6C), wherein each dosing mechanism (6A, 6B, 6C) is associated with just one storage container (9A, 9B, 9C) for receiving the one liquid (12) with at least one active substance (A, B, C) therefrom, and comprises:

a chamber (13), which receives the liquid (12) from the associated storage container (9A, 9B, 9C) via a hose (8) and comprises:

an at least partially moveable edge section (15) that can be displaced via a piezo actuator (16) located behind the edge section (15) outside of the chamber (13), and at least one dosing nozzle (7A, 7B, 7C) for actively pressing out, not under the influence of gravity alone, a number of droplets (17) of the received liquid (12) corresponding to the desired amount of the active substance (A, B, C) onto a substrate (2) or into a collecting vessel; and a common control system, to which all of the dosing mechanisms (6A, 6B, 6C) are linked, where the desired types and amounts of the active substances (A, B, C)

are entered, and which controls the dosing mechanisms (6A, 6B, 6C) to spray the appropriate dosages through the dosing nozzles (7, 14).

10. The device (1) according to claim 9, characterized by an activator (16) for the at least one dosing nozzle (14) that continuously generates droplets (17), but, depending upon the desired amount of active substance (A, B, C), only the droplets (17) that are required are pressed onto a substrate (2) or into a collecting vessel while the droplets (17) that are not required are collected and conducted back into the storage container (9).

11. The device (1) according to claim 10, characterized by at least one deflecting device, which deflects the required droplets (17) and the unneeded droplets (17) with different amounts of force.

12. The device (1) according to claim 11, characterized in that a plurality of dosing mechanisms (6A, 6B, 6C), in particular with one dosing nozzle (14) and/or with one dosing nozzle unit (7A, 7B, 7C) each, are arranged in a row.

13. The device (1) according to claim 12, characterized in that exactly one active substance storage container (9A, 9B, 9C) is associated with each dosing mechanism (6A, 6B, 6C) and/or each dosing nozzle (14) and/or each dozing nozzle unit (7A, 7B, 7C).

14. The device (1) according to claim 12, characterized in that the active substance dosing device (1) and/or the at least one dosing mechanism (6A, 6B, 6C) and/or the at least one dosing nozzle (14) and/or the at least one deflection mechanism (18, 19, 20) and/or the at least one dosing nozzle mechanism (7A, 7B, 7C) are fixed in place, i.e. are not on moveable slides.

15. The device (1) according to claim 12, characterized by one or more collecting vessels for collecting the required droplets (17) of a dosed active substance (A, B, C), in particular for the preparation of fluid medicaments.

16. The device (1) according to claim 15, characterized by a mechanism for generating a relative movement (5) among one or more active substance collecting vessels relative to the at least one active substance dosing nozzle (7A, 7B, 7C, 14), in particular in the form of a transport mechanism for one or more active substance collecting vessels.

17. The device (1) according to claim 16, characterized in that the conveying direction of the transport mechanism is parallel to the row of multiple dosing mechanisms (6A, 6B, 6C) and/or dosing nozzle mechanisms (7A, 7B, 7C) or (inner) dosing nozzles (14).

18. The device (1) according to claim 12, characterized by one or more preferably tablet-like substrates (2) for collecting the dosed active substance (A, B, C), in particular for impregnation with the dosed active substance (A, B, C).

19. The device (1) according to claim 18, characterized by a mechanism for generating a relative movement (5) among one or more tablet-like substrates (2) relative to the at least one active substance dosing mechanisms (6A, 6B, 6C) and/or dosing nozzle mechanism (7A, 7B, 7C), in particular in the form of a transport mechanism for one or more tablet-like substrates (2).

20. The device (1) according to claim 11, characterized in that the at least one dosing mechanism (6A, 6B, 6C) and/or dosing nozzle mechanism (7A, 7B, 7C) and/or the at least one deflection mechanism (18, 19, 20) are disinfected.

21. The device (1) according to claim 9, characterized by at least one charging electrode (18), which is arranged outside of the at least one dosing nozzle (14) in order to electrically charge the droplets (17) after they pass through the at least one dosing nozzle (14).

22. The device (1) according to claim 21, characterized by two pairs of deflection electrodes (19, 20), which are rotated by 90° about the flight direction of the droplets (17) in order to deflect the electrically charged droplets (17) to different locations or fields (24) of a grid (23) of the substrate (2).

23. The device (1) according to claim 9, characterized by the deflection electrodes (19, 20) that are arranged downstream of the at least one charging electrode (18) to deflect the electrically charged droplets (17) with different amounts of force depending on their classification such that required droplets (17) arrive at a substrate (2) or in a collecting vessel, while unneeded droplets (17) arrive in at least one collecting device (21), from which they are conducted back into the storage container (9).

24. The device (1) according to claim 23, characterized in that the at least one dosing nozzle (14), the at least one charging electrode (18) and/or the deflection electrodes (19, 20) are components of at least one print head of a continuous inkjet printer.

25. The device (1) according to claim 23, characterized by a control system for the deflection electrodes (19, 20) of the at least one dosing mechanism (6A, 6B, 6C) and/or dosing nozzle mechanism (7A, 7B, 7C).

26. The device (1) according to claim 25, characterized in that the control system is configured such that droplets (17) are dispensed onto the substrate (2) or into the collecting vessel only when it is located at a position provided for it along the conveying direction (5).

27. The device (1) according to claim 25, characterized in that the control system is configured such that various droplets (17) strike the substrate (2) or collecting vessel at different points or grid fields (24).

28. The device (1) according to claim 25, characterized in that the control system is configured such that a predetermined number of droplets per type of active substance (A, B, C) is dispensed onto the substrate (2) into the collecting vessel.

29. An active substance dosing device (1) for the preparation of tablet-like medicaments, comprising:

at least one storage container (9) for storing one liquid (12) each together with one or more active substances (A, B, C) that are dissolved within it, and at least one dosing mechanism (6A, 6B, 6C), wherein each dosing mechanism (6A, 6B, 6C) is supplied with the liquid (12) with at least one active substance (A, B, C) therein from one storage container (9) via a hose (8A, 8B, 8C), and comprises:

a dosing nozzle (7, 14) for actively pressing out, not under the influence of gravity alone, a number of droplets (17) of the liquid (12) corresponding to the desired amount of the active substance (A, B, C) therein onto tablet-like substrate bodies (2); and two pairs of deflection electrodes (19, 20), which are rotated by 90° about the flight direction of the droplets (17) in order to deflect the droplets (17) due to their electrical charge to different locations or fields (24) of a two-dimensional grid (23) of a tablet-like substrate body (2).

30. An active substance dosing method for the preparation of a liquid medicament, comprising the following steps:

dissolving one or more active substances (A, B, C) in one liquid (12) each to form one or more dissolved active substances;

storing each of the one or more dissolved active substances in a respective storage container (9);

providing a liquid solvent in a collecting vessel;

actively pressing a number of droplets (17) of the one or more dissolved active substances, corresponding to the desired amount of the respective dissolved active substance (A, B, C), not under the influence of gravity alone, through at least one dosing nozzle (7, 14) into the liquid solvent provided in the collecting vessel to form the liquid medicament containing the desired active substances (A, B, C) in the desired quantities.

31. An active substance dosing device (1) for the preparation of a liquid medicament, comprising:

at least one storage container (9) for storing one liquid (12) each together with one or more active substances (A, B, C) that are dissolved within it to form one or more dissolved active substances, and at least one dosing mechanism (6A, 6B, 6C), wherein each dosing mechanism (6A, 6B, 6C) is supplied with liquid (12) with at least one active substance (A, B, C) dissolved therein from one storage container (9) via a hose (8A, 8B, 8C), and comprises a dosing nozzle (7, 14) for actively pressing out, not under the influence of gravity alone, a number of droplets (17) of the liquid (12) corresponding to the desired amount of the active substance (A, B, C) therein into a liquid solvent in a collecting vessel to form the liquid medicament containing the desired active substances (A, B, C) in the desired quantities.

* * * * *